United States Patent [19]

Bridger et al.

[11] 4,053,387

[45] Oct. 11, 1977

[54] PROCESS FOR UPGRADING LUBRICATING OIL STOCK

[75] Inventors: Robert F. Bridger, Hopewell; Costandi A. Audeh; El-Ahmadi I. Heiba, both of Princeton, all of N.J.

[73] Assignee: Mobil Oil Corporation, New York, N.Y.

[21] Appl. No.: 693,829

[22] Filed: June 8, 1976

[51] Int. Cl.[2] ..... C10G 23/02; C10G 34/00

[52] U.S. Cl. ..... 208/88; 208/91; 208/264

[58] Field of Search ..... 208/18, 88, 89, 91, 208/143, 264

[56] References Cited

U.S. PATENT DOCUMENTS

| | | | |
|---|---|---|---|
| 2,967,147 | 1/1961 | Cole | 208/18 |
| 3,436,334 | 4/1969 | Orkin et al. | 208/18 |
| 3,793,186 | 2/1974 | Guenther et al. | 208/264 |
| 3,904,511 | 9/1975 | Heiba et al. | 208/177 |

*Primary Examiner*—Herbert Levine

*Attorney, Agent, or Firm*—Charles A. Huggett; Raymond W. Barclay; Dennis P. Santini

[57] ABSTRACT

A two-step process for preparing a stabilized lubricating oil resistant to oxidation and sludge formation upon exposure to a highly oxidative environment is provided. The first step of the present process comprises contacting a lubricating oil stock with elemental sulfur in the presence of a catalyst material selcted from the group consisting of alumina, silica, aluminosilicate, a metal of Groups II-A, II-B, VI-B or VIII of the Periodic Table of Elements, an oxide of a metal of Groups II-A, II-B, VI-B or VIII, a sulfide of a metal of Groups II-A, II-B, VI-B or VIII, clay, silica combined with an oxide of a metal of Groups II-A, III-A, IV-B or V-B, and combinations thereof in a flow reactor or under conditions comparable to those existing in a flow reactor. The second step of the present process comprises contacting the product of the first step with hydrogen in the presence of alumina impregnated with at least about 10 weight percent of $MoO_3$ and at least about 2.5 weight percent of CoO, said impregnated alumina having at least 50 percent of its pores with a pore diameter of 50 Angstrom Units or more.

9 Claims, No Drawings

PROCESS FOR UPGRADING LUBRICATING OIL STOCK

BACKGROUND OF THE INVENTION

1. Field of the Invention

This invention relates to the production of improved lubricating oils. In particular, it relates to an improved method of preparation of stable lubricating oils which are highly resistant to oxidation and sludge formation when exposed to a highly oxidative environment.

2. Description of Prior Art

Hydrocarbon lubricating oils have been obtained by a variety of processes in which high boiling fractions are contacted with hydrogen in the presence of hydrogenation-dehydrogenation catalysts at elevated temperature and pressures. In such processes there is a consumption of hydrogen. Lubricating oil fractions are separated from the resulting products. Such lubricating oil fractions differ from those obtained by fractional distillation of crude oils and the like, since they have such relatively high viscosity index values that solvent extraction treatments are generally not required to enhance their viscosity index values. Such lubricating oil fractions suffer from the shortcoming that they are unstable when exposed to highly oxidative environments. When so exposed, sediment and lacquer formation occurs, thus lessening the commercial value of such lubricants.

Methods in the art directed to lessening such a shortcoming are exemplified by U.S. Pat. Nos. 3,436,334 and 3,530,061. They teach making a lubricating oil product fraction of hydrocracking resistant to deterioration upon exposure to light and air by contacting the lubricating oil fraction with a solid contacting agent having hydrogenation-dehydrogenation properties under hydrogen pressure (U.S. Pat. No. 3,530,061); and making hydrocarbon lubricating oil resistant to such deterioration by contacting high boiling hydrocarbons with a hydrogenation-dehydrogenation catalyst and hydrogen (with hydrogen consumption), and thereafter dehydrogenating the resultant product on contact with a metal oxide or with metal and oxygen (U.S. Pat. No. 3,436,334). Both methods employ hydrogen atmosphere, high pressure and high temperature, i.e. 500° to 1000° F. No sulfur is employed in either patent method.

U.S. Pat. No. 3,904,511 teaches a batch operation process for stabilization of a lubricating oil stock which comprises contacting a high boiling hydrocarbon fraction lubricating oil stock with elemental sulfur in amount of from 0.2 to 1.0 percent by weight of the oil stock in the presence of a catalyst.

The present invention is directed to an improved process and means for effecting substantial improvement in oxidative properties of lubricating oil by a low pressure, relatively low temperature partial dehydrogenation mechanism in the presence of a small amount of elemental sulfur, e.g. 0.025 to 0.2 weight percent, and a catalyst.

U.S. Pat. No. 2,604,438 teaches a "hydroforming" process for catalytic dehydrogenation of light (i.e. boiling at less than 600° F) hydrocarbon oils, presumably to increase aromatic content. The patent discloses the known fact that in processes of that nature, the pressure of a small amount of sulfur in the feed has a beneficial effect. If further states that when the oil to be "hydroformed" has no sulfur, i.e. no sulfur in the light hydrocarbon feed, then a small amount of sulfur, e.g. a reducible sulfur compound, is added to the feed. The patent emphasizes that the invention disclosed therein "is only advantageous when the process is carried out at a temperature conductive to dehydrogeneration, i.e. at a temperature of at least 825° F." Proclaimed in the patent is the fact that when lower temperatures are used, e.g. 150° C to 225° C as in the present invention, "the described method offers no advantage."

The prior art practices of hydrofinishing and hydrotreating as a means of treatment of lubricating oil stocks (i.e. stocks boiling at temperatures over 600° F) leave behind the unstable oil fractions, i.e. hydroaromatic compounds, with labile hydrogen atoms such as, for example, fluorines, benzofluorenes, acenaphthenes, tetralin, fused cycloalkylaromatics and naphthenes, which are quite unstable toward oxygen, particularly in the presence of metals in lubricating oil formulations containing overbased additives. These hydroaromatic compounds with labile hydrogen atoms are known to be present in small quantities in conventionally furfural refined stocks and can lead to oxidative instability of any lubricant containing them. Further, it is well known that the sensitivity of certain lubricating oils toward alkaline additives can cause oxidative degradation in applications where overbased additives are used, such as automotive and diesel lubricants. Also, metal sensitivity can be quite detrimental to the oxidative stability of lubricants or functional fluids in applications such as turbine circulating oils, steam turbine oils and hydraulic fluids. No method is known at present which so effectively and easily alleviates the above problems as the present invention.

SUMMARY OF THE INVENTION

In accordance with the present invention there is provided an improved process and means for forming lubricating oils which are highly resistant to deterioration, e.g. oxidation and sludge formation, upon exposure to a highly oxidative environment.

The process of the present invention comprises the first step of contacting a lubricating oil stock such as, for example, from a Midcontinental U.S.A. crude or an Arabian Light crude, in a flow reactor or under conditions comparable to those existing in a flow reactor with elemental sulfur in amount of from about 0.025 to about 0.2 precent by weight of the oil stock in the presence of a catalyst material selected from the group consisting of alumina, silica, aluminosilicate, a metal of Groups II-A, II-B, VI-B or VIII of the Periodic Table of Elements, an oxide of a metal off Groups II-A, II-B, VI-B or VIII, a sulfide of a metal of Groups II-A, II-B, VI-B or VIII, clay, silica combined with an oxide of a metal of Groups II-A, III-A, IV-B or V-B and combinations thereof.

The elemental sulfur for use in the first step may be provided for the treatment, if desired, by a sulfur precursor, such as, for example, $H_2S$, an organosulfur compound, i.e. added or naturally occurring, or combinations thereof. Said naturally occurring organosulfur compound may be utilized if present in the lubricating oil stock in a quantity providing greater than about 0.125 weight percent sulfur. When such an organosulfur compound is the source of elemental sulfur herein, it can serve for generation of sulfur in situ. The catalyst materials for use in this invention serve to assist the extrustion of naturally occurring sulfur from the lubricating oil stock and, if sufficient organosulfur compounds are present therein, dehydrogenation is enhanced.

Non-limiting examples of sulfur precursors which may be utilized in the present process include $H_2S$, RSH, $RS_xH$, $HS_xH$, and $RS_xR$, wherein R is a hydrocarbyl group and $x$ is an integer of from 1 to 4 or more. Under actual operating conditions as herein set forth, these sulfur precursors, if used, can interact with the catalyst material for use herein to serve as a source of active sulfur in situ.

The present process comprises a second step of contacting the product of the first step with hydrogen in the presence of a specific catalyst comprised of alumina impregnated with CoO and $MoO_3$ at a hydrogen circulation rate of from about 100 to about 1500 scf/bbl.

DESCRIPTION OF SPECIFIC EMBODIMENTS

The lubricating oil stocks which may be treated in accordance with the present invention may generally be any high boiling range materials boiling above about 600° F. Such lubricating oil stock materials include those obtained by fractionation, as by, for example, vacuum distillation, of crude oils identified by their source, i.e. Pennsylvania, Midcontinent, Gulf Coast, West Texas, Amal, Kuwait, Barco and Arabian. Said oil stock materials include one having a substantial part thereof of the fractionation product of the above crude oils mixed with other oil stocks.

The catalyst materials employed in the first step of the present process can include any type of catalyst which will bring about partial dehydrogenation and sulfur labilization (or sulfurization-desulfurization) when applied to the lubricating oil stock in the presence of elemental sulfur in very small quantity and at low operting temmperature in an unpressured flow system. Such catlyst materials are known in the art for use in various other catalytic processes and include alumina, silica, silica combined with an oxide of a metal of Groups II-A, III-A, IV-B or V-B of the Periodic Table of Elements, such as, for example, silica-alumina, an aluminosilicate, a metal of Groups II-A, II-B, VI-B or VIII such as, for example, Mg, Ca, Zn, Cr, Mo, Fe, Co, Ni or Pt, an oxide of a metal of Groups II-A, II-B, IV-B or VIII such as CaO, MgO, $Fe_2O_3$, $MnO_2$, Crhd $2O_3$ or ZnO, a sulfide of a metal of Groups II-A, II-B, VI-B or VIII such as, for example, $Fe_2S$, $Fe_2S_3$, $FeS_2$, (either marcasite or pyrite) or $Fe_7S_8$ (pyrrhotite), certain clay and combinations thereof.

Non-limiting examples of the clays which may be useful as the catalyst material in the first step of the process of this invention include the montmorillonite and kaolin families, which families include the sub-bentonites and the kaolins commonly known as Dixie, NcNammee, Georgia and Florida clays, or other in which the main mineral constituent is halloysite, kaolin, dickite, nacrite, attapulgite or anauxite. Such clays can be used in the raw state as mined or initially subjected to calcination, acid treatment or chemical modifications.

Non-limiting examples of siliceous materials useful as the catalyst in the first step of the present invention include silica and combinations thereof with oxides of metals of Groups II-A, III-A, IV-B, and V-B, such as, for example, silica-alumina, silica-magnesia, silica-zirconia, silica-thoria, silica-beryllia, silica-titania, as well as thernary compositions of silica, such as, for example, silica-alumina-thoria and silica-alumina-zirconia Non-limiting examples of aluminosilicate materials which may be useful as the catalyst in he first step of the present invention include the synthetic zeolites A, B, L, T, X, Y, ZK-4, ZK-5, ZSM-4, ZSM-5, ZSM-35, ZSM-38 and others, and the natural zeolites levynite, dachiarite, erionite, faujasite, analcite, paulingite, noselite, phillipsite, chabazite, leucite, mordenite and others.

The catalyst of the first step losses some of its activity during use and, therefore, may be regenerated. The spent catalyst is contracted with a free oxygen-containing atmosphere at an elevated temperature sufficient to burn carbonaceous deposits from the catalyst. Conditions for regenerating the catalyst include a temperature between about 600° F and 1,000° F, a pressure of from atmospheric to about 500 pounds per square inch, a total gas flow rate of from about 1 to about 20 volumes per volume of catalyst per minute nd an oxygen concentration of from about 0.1 percent to 100 percent. The oxygen can be diluted with steam, nitrogen or other inert gas.

The first step of the present process involves the partial incorporation of sulfur into the lubricating oil stock or the partial desulfurization of the oil stock in addition to the partial dehydrogenation of the oil stock. Said dehydrogenation is believed to involve oxidatively unstable fractions of said oil stock including, for example, the above mentioned hydroaromatics such as fluorenes, benzofluorenes, acenaphthenes, tetralin, fused cycloalkylaromatics, naphthenes and the like. The unstable hydrogen of said hydroaromatics is eliminated from the oil stock treated in accordance herewith as one or more of the forms $H_2S$, RSH, $HS_xH$ and $RS_xR$, wherein R is a hydrocarbyl group and $x$ is an integer ranging from 1 to about 4 or more.

The elemental sulfur employed in the first step of the process of the present invention may be in any of several allotropic forms such as $S_6$, $S_8$ or polymeric sulfur and may be used in very small amounts of from about 0.025 to about 0.2 percent by weight of oil stock, with a preferable range of from about 0.05 to about 0.15 percent by weight. It is readily observable that this invention differs from the well-known method of making sulfurized oil-extreme pressure agents in conditions of processing, the concept of improvement, the amount and type of sulfur incorporated and the chemical modification of the oil stock itself. In the present invention, small amounts of stable sulfur may be chemically incorporated into the oil molecules as labile hydrogen atoms are removed. On the other hand, in sulfurized oils used as extreme pressure agents, large quantities of sulfur, such as, for example, 10 to 15 percent by weight, are incorporated, including a substantial quantity of elemental sulfur as such.

If desired in the first step of the present process, and specifically if desired when the lubricating oil stock being treated in accordance herewith contains substantial naturally occurring organosulfur compounds such that the sulfur content of the oil is greater than about 0.125 weight percent, a low partial pressuure of hydrogen may be applied to the catalyst-oil system of from about 15 to about 250 psig. The sulfur in such an embodiment of the present invention is provided in situ as hereinbefore described and the lubricating oil product is substantially improved in stability properties.

In practice of the present invention, a base or base precurosor may be used as a secondary agent in combination with the catalyst in the first step as above defined. Non-limiting examples of such secondary agents include lithium hydroxide, potassium hydroxide, potassium acetate, sodium hydroxide, sodium acetate and sodium carbonate. Such a combination of catalyst material and secondary agent promotes the fixing of sulfur and/or the dehydrogenation of labile hydrogen atoms.

The operating parameters in the first step of the present flow reactor process are critical to achieving the described result of degree of improvement or upgrading product quality of the lubricating oil stock treated without loss in yield. Aside from specific small amounts of sulfur, the first step reaction temperature must be within the range of from about 150° C to about 225° C, preferably from about 160° C to about 180° C. The first step reaction pressure may be from about 0 psig to about 500 psig, preferably from about 0 psig to about 200 psig. Liquid hourly space velocity (LHSV) in the first step must be maintained within the range of from about 0.5 to about 20 $hr^{-1}$ (vol. oil/vol. catalyst), preferably from about 1 to about 10 $hr^{-1}$ and more preferably from about 1 to about 5 $hr^{-1}$.

By using the flow process of the present invention as a first step, a smaller concentration of elemental sulfur is required in that step than if a batch process, e.g. U.S. Pat. No. 3,904,511, is used. When the batch process is used, there is needed from about 0.2 to about 1.0 percent by weight of the oil stock being treated of elemental sulfur. When the present flow process is used, i.e. a flow reactor or conditions comparable to those existing in a flow reactor, only from about 0.025 to about 0.2 percent by weight of the oil stock being treated of elemental sulfur is needed. Economic and processing benefits from the present process when compared to those of the prior art are readily noted. One such benefit is, of course, that removal of excess unreacted sulfur from the oil stock treated hereby is greatly facilitated by way of the second step of the present process. Further, corrosion problems inherent in the use of larger amounts of sulfur are solved.

The catalyst material employed in the second step of the present process must be alumina impregnated with at least about 10 weight percent $MoO_3$ and at least about 2.5 weight percent CoO. The impregnated alumina must have at least 50 percent of the pores with a pore diameter of 50 Angstrom Units or more. Other catalyst materials, although some have large pore size distribution, such as, for example, alumina impregnated with Fe-Cr-K, alumina impregnated with $MoO_3$ alone, and other catalysts of alumina impregnated with CoO and $MoO_3$, do not provide the desired results achieved by the present process (see Examples presented hereinafter). More specifically, the alumina catalyst for the second step must be impregnated with from about 2.5 to about 4 weight percent CoO, preferably from about 2.5 to about 3.5 weight percent; and from about 10 to about 15 weight percent $MoO_3$, preferably from about 10.5 to about 13.5 weight percent. The order and method of impregnation is not critical.

Operating parameters in the second step of the present process are critical, especially reaction pressure since the second step reaction is pressure dependent whereby too great a pressure will cause undesirable hydrogenating of the oil product from the first step of the process. The reaction pressure of the second step must be maintained within the range of from about 100 psig to about 300 psig, with a preferred pressure being within the range of from about 150 psig to about 250 psig. Reaction temperature should be maintained within the range of from about 80° C to about 190° C, with a preferred temperature within the range of from about 150° C to about 175° C. Hydroen must be present in the second step of this process with hydrogen circulation being maintained within the range of from about 100 scf/bbl to about 1500 scf/bbl, preferably from about 500 scf/bbl to about 1100 scf/bbl. The second step of this process may be conducted in a flow reactor or under conditions comparable to those existing in a flow reactor with a liquid hourly space velocity of from about 0.1 $hr^{-1}$ to about 10 $hr^{-1}$ (vol. oil/vol. catalyst), preferably from about 0.5 $hr^{-1}$ to about 2.5 $hr^{-1}$.

In order to more fully illustrate the process of the present invention, the following specific examples, which in no sense limit the invention, are presented. The test methods used herein were the standard Rotary Bomb Oxidation Test (RBOT) designated ASTM-D2272, the standard Copper Strip Corrosion Test designated ASTM-D130 and the standard Color Test designated ASTM-D1500. ASTM-D2272 was carried out to test oxidation properties of an oil blend, the base stock of which was prepared in accordance with the present invention. ASTM-D130 was conducted to demonstrate complete removval of corrosive sulfur from finished oils, the base stock of which was prepared hereby and ASTM-D1500 was conducted to show color improvement as a result of the present procedure. Each sample tested was blended with a standard commercial additive package prior to testing.

The lubricating oil stock used in the following examples was conventionally refined by distillation, followed by furfural extraction and methyl ethyl ketone dewaxing. It is identified in Table 1 according to source, physical properties and furfural conditons.

TABLE 1

CRUDE SOURCE AND NOMINAL VISCOSITY OF LUBRICATING OIL STOCK USED HEREIN

| | 150 S.U.S. Arabian Light |
|---|---|
| Furfural Dosage, % volume | 180 |
| Tower Temp., ° F, Top | 185 |
| Tower Temp., ° F, Bottom | 140 |
| Gravity, ° API | 30.9 |
| Pour Pt., ° F | 0 |
| Flash Pt., ° F | 410 |
| Sulfur, % wt. | 0.63 |
| Nitrogen, % wt. | 0.0029 |
| Aniline Point, ° F | 210 |
| Viscosity S.U.S. at 100° F | 152 |
| Viscosity Index | 103 |
| ASTM Color | 1½ |

EXAMPLE 1

A 50 gramm quantity of the above oil stock, without treatment in accordance with the present invention, was subjected to each of the above tests. The results of the tests are recorded in Table 2 for comparison purposes with tests conducted on the same oil stock treated by the present two-step process (Examples 2–7).

EXAMPLE 2

A 450 gram quantity of the above oil stock was mixed with 0.1 weight percent of elemental sulfur (based on weight of oil) and allowed to flow through a 15 ml. downflow reactor containing 10 gramms of 1/16-inch zeolite X (i.e. NaX) under reaction conditions including a temperature of 160° C, a pressure of 25 psig and a liquid hourly space velocity (LHSV) of 1 $hr^{-1}$.

The sulfur-contacted oil was then contacted with hydrogen under a pressure of 100 psig, a temperature of 160° C and LHSV of 1 hr $hu^{-1}$ in the presence of 10 grams of alumina impregnated with 13.1 weight percent of $MoO_3$ and 2.5 weight percent of CoO. The hydrogen circulation rate was 1000 scf/bbl.

The impregnated alumina catalyst had the following properties:

| | |
|---|---|
| Pore Volume, cc/g | 0.512 |
| Packed Density, g/cc | 0.771 |
| Adj. Pore Volume, cc/cc | 0.395 |
| Pore Size Distribution, cc/cc | |
| 0–50 A | 0.069 |
| 50–100 | 0.230 |
| 100–150 | 0.073 |
| 150–200 | 0.004 |
| >200 | 0.019 |

The impregnated alumina catalyst was pre-sulfided by passing $H_2S$ through the catalyst for one hour at 427° C. It was then cooled to 200° C in a stream of $H_2S$ and allowed to cool to room temperature in a stream of hydrogen before use.

The product oil was then tested in each of the above-described tests and shown to have improved oxidation properties and excellent corrosion and color properties, as demonstrated in Table 2.

EXAMPLE 3

A 450 gram quantity of the above oil stock was mixed with 0.05 weight percent of elemental sulfur (based on weight of oil) and allowed to flow through the reactor of Example 2 (first paragraph) under reaction conditions including a temperature of 175° C, a pressure of 25 psig and a LHSV of 5 $hr^{-}$.

The sulfur-contacted oil was then contacted with hydrogen under a pressure of 100 psig, a temperature of 175° C and a LHSV of 1 $hr^{-1}$ in the presence of 10 grams of the $CoO$-$MoO_3$/alumina identified in Example 2. The hydrogen circulation rate was 1000 scf/bbl.

The product oil was then tested as in Example 2 and shown to have improved oxidation properties and excellent corrosion and color properties, as demonstrated in Table 2.

EXAMPLE 4

A 450 gram quantity of the above oil stock was mixed with 0.025 weight percent of elemental sulfur (based on weight of oil) and allowed to flow through the reactor of Example 2 (first paragraph) under reaction conditions including a temperature of 175° C, a pressure of 50 psig and a LHSV of 10 $hr^{-1}$.

The sulfur-contacted oil was then contacted with hydrogen under a pressure of 100 psig, a temperature of 185° C and a LHSV of 2 $hr^{-1}$ in the presence of 10 grams of the $CoO$-$MoO_3$/alumina identified in Example 2. The hydrogen circulation rate was 1000 scf/bbl.

The product oil was then tested as in Example 2 and shown to have improved oxidation properties and excellent corrosion and color properties, as demonstrated in Table 2.

EXAMPLE 5

A 450 gram quantity of the above oil stock was mixed with 0.15 weight percent of elemental sulfur (based on weight of oil) and allowed to flow through the reactor of Example 2 (first paragraph) under reaction conditions including a temperature of 180° C, a pressure of 25 psig and a LHSV of 7.2 $hr^{-1}$.

The sulfur-contacted oil is then contacted with hydrogen under a pressure of 200 psig, a temperature of 80° C and a LHSV of 3 $hr^{-1}$ in the presence of 10 grams of the $CoO$-$MoO_3$/alumina identified in Example 2. The hydrogen circulation rate is 1500 scf/bbl.

The product oil is then tested as in Example 2 and shown to have to have improved oxidation properties and excellent corrosion and color properties, as demonstrated in Table 2.

EXAMPLE 6

A 450 gram quantity of the above oil stock was mixed with 0.1 weight percent of elemental sulfur (based on weight of oil) and allowed to flow through a 15 ml. downflow reactor containing 10 grams of 8–12 mesh rare earth exchanged zeolite Y (i.e. REY) under reaction conditions including a temperature of 175° C, a pressure of 25 psig and a LHSV of 1 $hr^{-1}$.

The sulfur-contacted oil is then contacted with hydrogen under a pressure of 300 psig, a temperature of 150° C and a LHSV of 5 $hr^{-1}$ in the presence of 10 grams of the $CoO$-$MoO_3$/alumina identified in Example 2. The hydrogen circulation rate is 750 scf/bbl.

The product oil is then tested as in Example 2 and shown to have improved oxidation properties and excellent corrosion and color properties, as demonstrated in Table 2.

EXAMPLE 7

A 450 gram quantity of the above oil stock is mixed with 0.2 weight percent of elemental sulfur (based on weight of oil) and allowed to flow through the reactor of Example 2 (first paragraph) containing 40 mesh silica/alumina under reaction conditions including a temperature of 150° C, a pressure of 75 psig and a LHSV of 2 $hr^{-1}$.

The sulfur-contacted oil is then contacted with hydrogen under a pressure of 100 psig, a temperature of 175° C and a LHSV of 7.6 $hr^{-1}$ in the presence of 10 grams of the $CoO$-$MoO_3$/alumina identified in Example 2. The hydrogen circulation rate is 1000 scf/bbl.

The product oil is then tested as in Example 2 and shown to have improved oxidation properties and excellent corrosion and color properties, as demonstrated in Table 2.

TABLE 2

| Test Results of Examples 1–7 | | | |
|---|---|---|---|
| Example | Copper Strip Test | Color Test | RBOT, minutes |
| 1 | 1A | 1.5 | 268 |
| 2 | 1A | 0.5 | 358 |
| 3 | 1A | 0.5 | 342 |
| 4 | 1A | 0.5 | 325 |
| 5 | 1A | 0.75 | 330 |
| 6 | 1A | 1.0 | 330 |
| 7 | 1A | 0.5 | 340 |

To illustrate for comparison purposes the facts that (1) use of the first of the present invention without the second step of (2) use of the first step with a second step not conforming to the present invention, i.e. with a different catalyst mterial, does not provide satisfactory lubricating oil product, Examples 8-16 are presented.

EXAMPLES 8–16

These examples were each conducted, as a first step, in accordance with the first step of the present invention, e.g. Example 2, first paragraph, to obtain a sulfur-contacted oil (same oil stock as used in Examples 1–7). The Copper Strip and Color tests were conducted in one instance without the benefit of conducting the second step of the present process beforehand (Example 8). In four other instances, the sulfur-contacted oil was contacted with hydrogen in the presence of a commercially available hydrofinishing catalyst identified as alumina impregnated with only $MoO_3$ under the following conditions:

| Example | LHSV, $hr^{-1}$ | Hydrogen Pressure, psig | Temperature, °C |
|---|---|---|---|
| 9 | 1 | 200 | 160 |
| 10 | 1 | 200 | 175 |
| 11 | 1 | 200 | 195 |
| 12 | 1 | 250 | 250 |

In two other instances, the sulfur-contacted oil was contacted with hydrogen in the presence of another commercially available hydrofinishing catalyst identified as alumina impregnated with 3 weight percent CoO and only 9 weight percent $MoO_3$ under the following conditions:

| Example | LHSV, $hr^{-1}$ | Hydrogen Pressure, psig | Temperature, °C |
|---|---|---|---|
| 13 | 1 | 200 | 160 |
| 14 | 1 | 200 | 200 |

In two other instances, the sulfur-contacted oil was contacted with yet another commercially available hydrofinishing catalyst identified as alumina impregnated with Fe, Cr and K under the following conditions:

| Example | LHSV, $hr^{-1}$ | Hydrogen Pressure, psig | Temperature, °C |
|---|---|---|---|
| 15 | 1 | 200 | 175 |
| 16 | 1 | 200 | 225 |

The product oils obtained from Examples 8–16 were subjected to each of the above tests. The results of the tests are recorded in Table 3.

TABLE 3

| Test Results of Examples 8–16 | | | |
|---|---|---|---|
| Example | Copper Strip Test | Color Test | RBOT, minutes |
| 8 | 4B | 3.5 | — |
| 9 | 4B | 4 | 340 |
| 10 | 3A | 3 | 330 |
| 11 | 3A | 2.5 | 300 |
| 12 | 1A | 1.5 | 250 |
| 13 | 4B | 4 | 335 |
| 14 | 3B | 3 | 320 |
| 15 | 4B | 4 | 325 |
| 16 | 1B | 2 | 290 |

What is claimed is:

1. A process for preparing a stabilized lubricating oil resistant to oxidation and sludge formation upon exposure to a highly oxidative environment which comprises a first step of contacting a high boiling hydrocarbon fraction lubricating oil stock with elemental sulfur in the presence of a catalyst material selected from the group consisting of alumina, silica, aluminosilicate, a metal of Groups II-A, II-B, VI-B or VIII of the Periodic Table of Elements, an oxide of a metal of Groups II-A, II-B, VI-B or VIII, a sulfide of a metal of Groups II-A, II-B, VI-B or VIII, clay, silica combined with an oxide of a metal of Groups II-A, III-A, IV-B or V-B. and combinations thereof in a flow reactor at a reaction temperature of from about 150° C to about 225° C, a reaction pressure of from about 0 psig to about 500 psig, a liquid hourly space velocity of from about 0.5 $hr^{-1}$ to about 20 $hr^{-1}$, said elemental sulfur being added in an amount of about 0.025 to about 0.2 percent by weight of said oil stock, and a second step of contacting the product of the first step with hydrogen in the presence of alumina impregnated with at least about 10 weight percent of $MoO_3$ and at least about 2.5 weight percent of CoO, said impregnated alumina having at least 50 percent of its pores with a pore diameter of 50 Angstrom Units or more, at a reaction temperature of from about 80° C to about 190° C, a reaction pressure of from about 100 psig to about 300 psig and a liquid hourly space velocity of from about 0.1 $hr^{-1}$ to about 10 $hr^{-1}$, said hydrogen in the second step being circulated at from about 100 scf/bbl to about 1500 scf/bbl.

2. The process of claim 1 wherein said oil stock has a boiling range of above about 600° F.

3. The process of claim 1 wherein said second step is conducted at a liquid hourly space velocity of from about 0.5 $hr^{-1}$ to about 2.5 $hr^{-1}$.

4. The process of claim 2 wherein said elemental sulfur in said first step is added in amount of from about 0.05 to about 0.15 percent by weight of said oil stock, said reaction temperature in said first step is from about 160° C to about 180° C, said reaction pressure in said first step is from about 0 psig to about 200 psig and said liquid hourly space velocity in said first step is from about 1 $hr^{-1}$ to about 10 $hr^{-1}$.

5. The process of claim 3 wherein said elemental sulfur in said first step is added in amount of from about 0.05 to about 0.15 percent by weight of said oil stock, said reaction temperature in said first step is from about 160° C to about 180° C, said reaction pressure in said first step is from about 0 psig to about 200 psig and said liquid hourly space velocity in said first step is from about 1 $hr^{-1}$ to about 10 $hr^{-1}$.

6. The process of claim 4 wherein said liquid hourly space velocity in said first step is from about 1 $hr^{-1}$ to about 5 $hr^{-1}$.

7. The process of claim 5 wherein said liquid hourly space velocity in said first step is from about 1 $hr^{-1}$ to about 5 $hr^{-1}$.

8. The process of claim 2 wherein said second step is conducted at a temperature of from about 150° C to about 175° C, a pressure of from about 150 psig to about 250 psig and wherein said hydrogen in said second step is circulated at a rate of from about 500 scf/bbl to about 1100 scf/bbl.

9. The process of claim 3 wherein said second step is conducted at a temperature of from about 150° C to about 175° C, a pressure of from about 150 psig to about 250 psig and wherein said hydrogen in said second step is circulated at a rate of from about 500 scf/bbl to about 1100 scf/bbl.

* * * * *

UNITED STATES PATENT AND TRADEMARK OFFICE

CERTIFICATE OF CORRECTION

PATENT NO. : 4,053,387

DATED : October 11, 1977

INVENTOR(S) : ROBERT F. BRIDGER, COSTANDI A. AUDEH and EL-AHMADI I. HEIBA

It is certified that error appears in the above-identified patent and that said Letters Patent are hereby corrected as shown below:

| | |
|---|---|
| ABSTRACT, line 6 | "selcted" should read --selected--. |
| Column 1, line 63 | "pressure" should read --presence--. |
| Column 2, line 3 | "conductive" should read --conducive--. |
| Column 2, line 13 | "fluorines" should read --fluorenes--. |
| Column 2, line 50 | "off" should read --of--. |
| Column 3, line 32 | "operting" should read --operating--. |
| Column 3, line 33 | "temmperature" should read --temperature--. |
| Column 3, line 34 | "catlyst" should read --catalyst--. |
| Column 3, line 42 | "Crhd $20_3$" should read --$Cr_2O_3$--. |
| Column 3, line 66 | "he" should read --the--. |
| Column 6, line 20 | "removval" should read --removal--. |
| Column 6, line 30 | Insert the word --extraction-- between the words "furfural" and "conditions". |
| Column 6, line 62 | "gramms" should read --grams--. |
| Column 6, line 63 | Insert the word --extrudate-- before the word "zeolite". |
| Column 6, line 68 | "1 hr $hu^{-1}$" should read --1 $hr^{-1}$--. |
| Column 7, line 32 | "5 $hr^{-}$." should read --5 $hr^{-1}$.-- |
| Column 8, line 59 | "mterial" should read --material--. |

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*